United States Patent [19]

Morris

[11] Patent Number: 5,036,670

[45] Date of Patent: Aug. 6, 1991

[54] CRYOGENIC REFRIGERATOR WITH CORNER SEAL

[75] Inventor: Ronald N. Morris, Newtonville, Mass.

[73] Assignee: Helix Technology Corporation, Waltham, Mass.

[21] Appl. No.: 466,974

[22] Filed: Jan. 18, 1990

[51] Int. Cl.[5] ..... F25B 9/00

[52] U.S. Cl. ..... 62/6; 60/520; 92/86; 277/53

[58] Field of Search ..... 62/6; 60/520; 92/86; 277/53

[56] References Cited

U.S. PATENT DOCUMENTS

| | | | |
|---|---|---|---|
| 1,983,977 | 12/1934 | Geiger | 285/123 |
| 3,186,743 | 6/1965 | Russell, Jr. | 285/238 |
| 3,832,935 | 9/1974 | Syassen | 92/86 |
| 4,418,918 | 12/1983 | Nicoll | 277/1 |
| 4,543,792 | 10/1985 | Bertsch | 62/6 |
| 4,578,956 | 4/1986 | Young | 62/6 |
| 4,724,676 | 2/1988 | Lewis | 62/6 |
| 4,842,287 | 6/1989 | Weeks | 62/6 |

*Primary Examiner*—Ronald C. Capossela

*Attorney, Agent, or Firm*—Hamilton, Brook, Smith & Reynolds

[57] ABSTRACT

In a cryogenic refrigerator, a displacer 12 and its drive piston 28 are guided by a displacer guide 32 seated within an expander body 16. An expander cap 40 enclosing a spring volume 38 extends within the expander body 16 and abuts the displacer guide 32. An indium seal 50 is positioned in the chamfer at the intersection of the cap, body and guide.

11 Claims, 1 Drawing Sheet

CRYOGENIC REFRIGERATOR WITH CORNER SEAL

BACKGROUND OF THE INVENTION

A conventional split Stirling refrigeration system includes a reciprocating compressor and an expander cold finger. The piston of the compressor provides a nearly sinusoidal pressure variation in a pressurized refrigeration gas such as helium. The pressure variation in a head space is transmitted through a supply line to the expander.

Within the housing of the expander a cylindrical displacer is free to move in a reciprocating motion to change the volumes of a warm space and a cold space. The displacer contains a regenerative heat exchanger comprised of several hundred fine-mesh metal screen discs stacked to form a cylindrical matrix. Other regenerators, such as those with packed balls, are also known. Helium is free to flow through the regenerator between the warm space and the cold space. A piston element extends upwardly from the main body of the displacer into a gas spring volume at the warm end of the cold finger.

The refrigeration system can be seen as including two isolated volumes of pressurized gas. A working volume of gas comprises the gas in the space at the end of the compressor, the gas in the supply line, and the gas in the spaces and in the regenerator of the expander cold finger. The second volume of gas is the gas spring volume which is sealed from the working volume by a piston seal surrounding the drive piston. The displacer is driven at least partially by pressure differentials across the drive piston. Additional drive may be obtained by a linear drive motor in which the armature is coupled to the end of the piston.

Examples of prior Stirling cryogenic refrigerators can be found in U.S. Pat. Nos. 4,543,792 and 4,578,956.

SUMMARY OF THE INVENTION

With very small cryogenic refrigerators, assembly of the displacer and the expander housing, and particularly sealing of gas within the housing, becomes difficult.

In accordance with the present invention, a unique assembly of the expander housing minimizes the number of seals required. Specifically, an expander tube in which the displacer reciprocates extends from an expander body. The displacer and drive piston are guided in reciprocating movement by a displacer guide seated in the expander body. An expander cap encloses the spring volume. The cap extends within the expander body and abuts the displacer guide. A seal is positioned at the intersection of the expander body, displacer guide and expander cap in order to seal both the working volume and the spring volume from the surrounding atmosphere.

A crushed, soft metal seal such as indium provides efficient sealing over a wide range of temperatures, and the metal seal can be significantly smaller than would be a conventional thermoplastic 0-ring.

Thus, the seal assembly comprises a first member (the expander cap), a second member (the displacer guide) and a third member (the expander body). The first and second members axially abut each other along a first surface and circumferentially abut the third member along second and third surfaces. A chamfer is formed in at least one of the first and second members at the intersection of the first, second and third surfaces. A soft, crushed metal seal such as indium is positioned in the chamfer.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DESCRIPTION OF A PREFERRED EMBODIMENT

Figure 1:
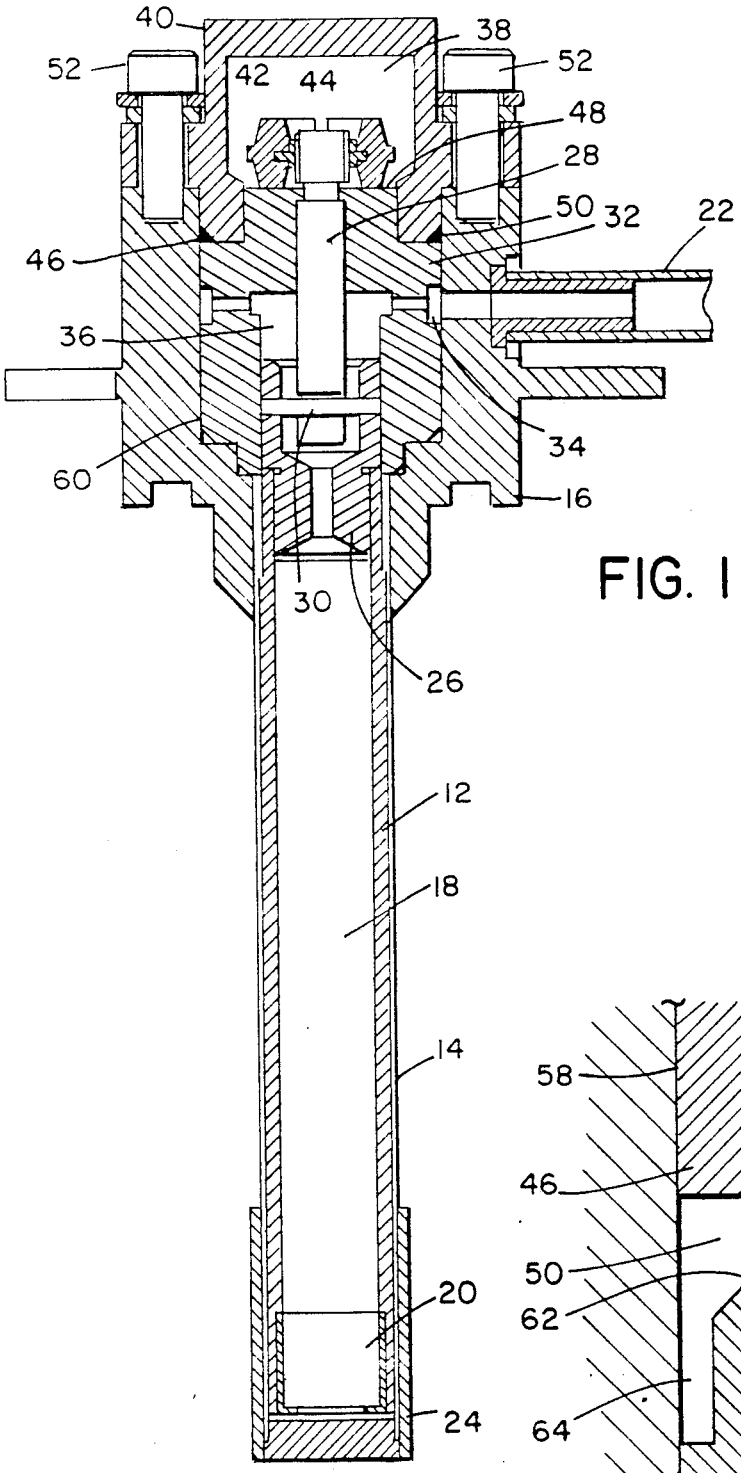
FIG. 1 is a cross-sectional view of an expander assembly embodying the present invention.

FIG. 1 illustrates the expander assembly of a cryogenic refrigerator embodying the present invention. A G10 fiberglass displacer 12 reciprocates within a stainless steel expander tube which extends from a stainless steel expander body 16. The displacer is filled with stacked screen 18 which serves as a regenerative matrix. The screen is retained in the displacer by an end cap 20. As discussed below, with reciprocation of the displacer in the tube 14, gas is displaced through the regenerative matrix between opposite ends of the tube in synchronization with a pressure wave created by a compressor piston (not shown). The pressure wave is delivered to the expander through a supply line 22. Through operation of the system, the distal end of the expander tube reaches cryogenic temperatures of 120K or less. A cooled thermal mass 24 mounted at the end of the expander tube 14 serves as a heat station for cooling a device such as an infrared detector or a cryopanel in a cryopump.

The particular application for which the present invention was designed is that of cooling a small infrared detector. According to the design specification, the expander body 16 has a diameter of less than one inch.

The warm end of the displacer 12 is closed by a clearance seal element 26 which in this case is formed of a cermet material such as Ferrotic. A center hole through the clearance seal element allows for the passage of the displaced helium refrigerant. The clearance seal element 26 is coupled to a drive piston 28 through a wrist pin 30. Preferably, the drive piston is also of a cermet material. The clearance seal element 26 and the drive piston 28 are guided in respective bores of a ceramic displacer guide 32. The displacer guide is positioned within the expander body 16 with a very close fit. The guide 32 has an annulus 34 about its periphery in communication With the helium supply line 22. A plurality of radial holes provide communication from the annulus 34 to the warm volume 36 within the displacer guide.

The piston is driven by pressure differentials between the warm volume 36 and a spring volume 38 into which the drive piston extends. The spring volume 38 is defined by an expander cap 40. A bumper nut, formed of silicon rubber molded about a threaded brass nut 44, is threaded onto the upper end of the drive piston 28.

The expander cap includes an axial cylinder 46 which extends between the upper end of the expander body 16 and a hub 48 of the displacer guide. Before setting the expander cap in place, a line of soft metal sealing material such as indium is laid into a seal spaced. The space is formed by a chamfer, formed in the guide 32 or cap 40 at the intersection of the guide, cap, and expander body 16. The cap is clamped down against the seal 50 by bolts 52 which are threaded into the expander body 16.

Figure 2:
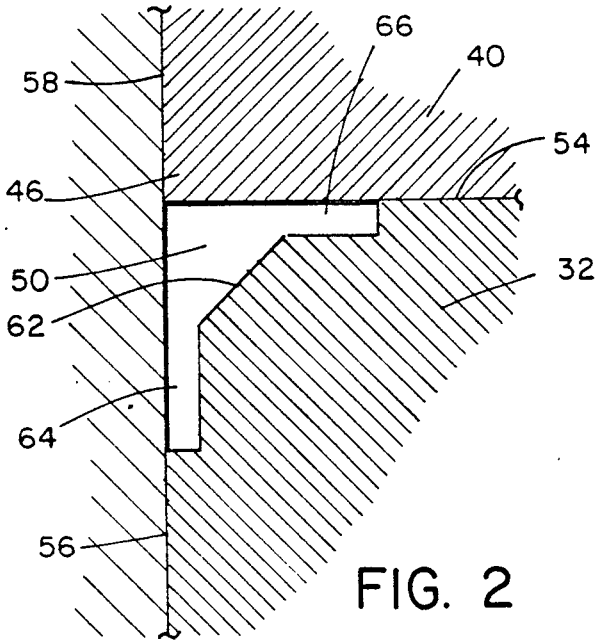
FIG. 2 is an enlarged view of the expander housing seal used in the assembly of FIG. 1.

An enlarged view of the seal is illustrated in FIG. 2. In this view, a chamfer is formed in the guide 32 rather than in the expander cap 40 as was illustrated in FIG. 1. The chamfer may be formed in either or both of those elements. Because of the configuration of the expander body, expander cap and displacer guide, the single seal seals the spring volume, communicating along the surface 54, and the warm working volume, communicating along the surface 56 from each other and, from atmosphere which communicates along the surface 58.

The close fit of the displacer guide 32 within the expander body 16 provides sufficient sealing along the interface 60 because only a small pressure differential is seen between the annulus 34 and the helium barrier between the expander body 16 and the displacer 12.

The chamfer is shaped to maximize the sealing surface area with a minimal amount of seal material. Thus, the chamfer has a bevel surface 62 which joins to flat grooves 64 and 66. The total volume of the chamfer matches that of the indium string placed in the chamfer. In a specific implementation, indium of 0.032 inch diameter is used. When the expander cap 40 is clamped against the displacer guide, the indium is caused to flow within the chamfer to fill the chamfer and provide proper sealing.

The conventional operation of the split Stirling refrigeration system will now be described. At the point in the cycle shown in FIG. 1, the displacer is at the cold end of the cold finger, and the compressor is compressing the gas in the working volume. This compressing movement of the compressor piston causes the pressure in the working volume to rise from a minimum pressure to a maximum pressure. The heat of compression is transferred to the environment so the compression is near isothermal. The pressure in the gas spring volume 38 is stabilized at a level between the minimum and maximum pressure levels of the working volume. Thus, at some point the increasing pressure in the working volume creates a sufficient pressure difference across the drive piston 28 to overcome retarding forces. The displacer then moves rapidly upward. With this movement of the displacer, high-pressure working gas at about ambient temperature is forced through the regenerator 18 into the cold space adjacent heat station 24. The regenerator absorbs heat from the flowing pressurized gas, and thereby reduces the temperature of the gas.

With the nearly sinusoidal drive from a crank shaft mechanism, the compressor piston now begins to expand the working volume. With expansion, the high pressure helium in the cold space is cooled even further, but heat transfer from the cooled environment results in a near isothermal expansion. It is this cooling of the cold space which provides the refrigeration for maintaining a temperature difference of over 200 degrees Kelvin over the length of the regenerator.

At some point in the expanding movement of the compressor piston, the pressure in the working volume drops sufficiently below that in the gas spring volume 38 for the gas pressure differential across the piston portion 28 to overcome retarding forces. The displacer is then driven downward to the position of FIG. 1. The gas in the cold space is thus driven through the regenerator to extract heat from the regenerator.

While this invention has been particularly shown and described with reference to a preferred embodiment thereof, it will be understood by those skilled in the art that various changes in form and details may be made therein without departing from the spirit and scope of the invention as defined by the appended claims. For example, the invention has application to systems other than Stirling refrigerators.

I claim:

1. A cryogenic refrigerator comprising a displacer driven in an expander tube by a drive piston which extends from the displacer into a gas spring volume, wherein the expander tube extends from an expander body, the displacer and the drive piston are guided in reciprocating movement by a displacer guide seated in the expander body, the displacer guide having a hub which extends toward the gas spring volume, and an expander cap enclosing the spring volume has a cap cylinder which extends within the expander body about the hub, an end surface of the cap cylinder abutting a shoulder of the displacer guide about the hub, a seal being positioned at an intersection of the expander body, displacer guide and expander cap within the expander body where the cap cylinder abuts the displacer guide.

2. A cryogenic refrigerator as claimed in claim 1 wherein the displacer guide includes an annulus about its outer circumference to which refrigerant is ported through the expander body, there being a plurality of ports from the annulus through a volume within the guide in which the displacer reciprocates.

3. A cryogenic refrigerator as claimed in claim 2 wherein the displacer guide is tightly fit within the expander body without additional seals.

4. A cryogenic refrigerator as claimed in claim 1 wherein the seal comprises a soft, crushed metal.

5. A cryogenic refrigerator as claimed in claim 1 wherein the seal comprises indium.

6. A cryogenic refrigerator as claimed in claim 1 wherein a chamfer is formed in at least one of the cap cylinder and expander body at the intersection of the expander body, displacer guide and expander cap and a seal of soft, crushed metal is positioned in the chamfer.

7. A cryogenic refrigerator as claimed in claim 10 wherein the seal is indium.

8. A cryogenic refrigerator as claimed in claim 6 wherein the chamfer comprises a bevel between flat grooves formed in adjacent surfaces of that least one of the cap cylinder and expander body.

9. A cryogenic refrigerator as claimed in claim 8 wherein the seal is indium.

10. A cryogenic refrigerator comprising a displacer driven in a working volume in an expander tube by a drive piston which extends from the displacer into a gas spring volume, wherein the expander tube extends from an expander body, the displacer and the drive piston are guided in reciprocating movement by a displacer guide seated in the expander body, and an expander cap enclosing the spring volume abuts the displacer guide and the expander body, a seal being positioned at an intersection of the expander body, displacer guide and expander cap, the seal sealing the working volume and spring volume from each other and from atmosphere.

11. A cryogenic refrigerator as claimed in claim 10 wherein the seal comprises a soft, crushed metal.

* * * * *

UNITED STATES PATENT AND TRADEMARK OFFICE

CERTIFICATE OF CORRECTION

PATENT NO. : 5,036,670

DATED : August 6, 1991

INVENTOR(S) : Ronald N. Morris

It is certified that error appears in the above-identified patent and that said Letters Patent is hereby corrected as shown below:

In Claim 3, column 4, line 34, change "claim 2" to --claim 1--.

In Claim 7, column 4, line 46, change "claim 10" to --claim 6--.

In Claim 8, column 4, line 50, change "of that least one" to --of the at least one--.

Signed and Sealed this

Twenty-ninth Day of December, 1992

*Attest:*

DOUGLAS B. COMER

*Attesting Officer*

*Acting Commissioner of Patents and Trademarks*